United States Patent [19]

Luchetta

[11] Patent Number: 4,950,219

[45] Date of Patent: Aug. 21, 1990

[54] ADJUSTABLE WEIR STRUCTURE FOR A DECANTER CENTRIFUGE

[75] Inventor: Joseph F. Luchetta, Doylestown, Pa.

[73] Assignee: Alfa-Laval AB, Stockholm, Sweden

[21] Appl. No.: 260,535

[22] Filed: Oct. 20, 1988

[51] Int. Cl.[5] ..... B04B 1/12; B04B 1/20

[52] U.S. Cl. ..... 494/53; 494/56

[58] Field of Search ..... 494/37, 50, 53, 54, 494/56, 84, 38, 55, 85; 210/369, 370, 371, 781, 782; 138/45, 46

[56] References Cited

U.S. PATENT DOCUMENTS

| | | | |
|---|---|---|---|
| 225,631 | 3/1880 | Muller | 210/371 |
| 273,038 | 2/1883 | Decastro et al. | 494/56 |
| 444,619 | 1/1891 | Peck | 494/56 |
| 1,854,313 | 4/1932 | Petsche et al. . | |
| 2,054,058 | 9/1936 | Laughlin . | |
| 2,468,632 | 4/1949 | Johnson . | |
| 2,700,989 | 2/1955 | De Benedetti et al. | 138/46 |
| 2,735,614 | 2/1956 | Hubmann . | |
| 3,228,594 | 1/1966 | Amero . | |
| 3,423,015 | 1/1969 | O'Conor . | |
| 3,580,492 | 5/1971 | Schnittger et al. . | |
| 3,623,656 | 11/1971 | Lavanchy . | |
| 3,795,361 | 3/1974 | Lee . | |
| 4,381,849 | 5/1983 | Conant | 494/53 |
| 4,575,370 | 3/1986 | LaMontagne . | |
| 4,764,163 | 8/1988 | Caldwell | 494/53 X |

FOREIGN PATENT DOCUMENTS

| | | | |
|---|---|---|---|
| 477771 | 10/1951 | Canada | 138/45 |
| 425150 | 2/1926 | Fed. Rep. of Germany | 494/56 |
| 16509 | 5/1902 | Sweden | 494/56 |
| 257767 | 9/1926 | United Kingdom | 494/56 |

OTHER PUBLICATIONS

"Investigation of the Clarification Process in Decanter Centrifuges", *Ger. Chem. Eng.* 9 (1986), 136–142, Faust and Gosele.

*Primary Examiner*—Harvey C. Hornsby
*Assistant Examiner*—Scott J. Haugland
*Attorney, Agent, or Firm*—Seidel, Gonda, Lavorgna & Monaco

[57] ABSTRACT

A centrifuge apparatus having an adjustable weir surface for adjusting the depth of an annular pool of a light and heavy phase material mixture therein. A first annular plate is positioned over a discharge outlet and includes a plurality of notches, each defining a generally arcuate opening and in the periphery thereof. A second annular plate is positioned in coaxial parallel juxtaposition with said first annular plate and also includes an identical amount of notches, each defining a generally arcuate opening. The annular plates are angularly positioned with respect to each other such that the generally arcuate openings are placed in overlapping relationship. Therefore, depending upon the relative angular position of the annular plates with respect to each other, the weir length can be increased and decreased.

13 Claims, 4 Drawing Sheets

ADJUSTABLE WEIR STRUCTURE FOR A DECANTER CENTRIFUGE

FIELD OF THE INVENTION

This invention relates to decanter centrifuges and, more particularly, to improved configurations of a weir structure employed therewith for adjusting the depth of an annular pool of a light and heavy phase material mixture within the centrifuge bowl.

BACKGROUND OF THE INVENTION

Conventionally, decanter centrifuges comprise an elongated bowl, tapered at one end, and mounted for rotation about an axis. Coaxially mounted within the bowl is a helical screw conveyor which is adapted to rotate at a speed slightly different from that of the speed of the bowl. Such centrifuges are capable of continuously receiving feed material in the bowl and rapidly separating the feed material into layers of light and heavy phase materials, which are discharged separately from the bowl. It is the function of the screw conveyor to convey the outer layer of conveyable heavy phase material, usually solids or semi-solids, to a discharge outlet therefor, usually located in a tapered end portion of the bowl.

Effective and efficient centrifugal separation requires that the light phase material, usually liquid, be discharged through an outlet with the discharge containing little or no heavy phase material. In addition, the heavy phase material should contain only a small amount of light phase material. For example, if the light phase material is water and the heavy phase material comprises soft solids, it is preferred that clear water and relatively drier solids be separately discharged. This type of decanter centrifuge is disclosed in U.S. Pat. No. 3,795,361 and is hereby incorporated by reference.

In order to maintain an annular layer of light and heavy phase materials within the bowl, a dam structure is incorporated within the light phase material discharge outlet. The dam structure includes a weir surface which determines the annular depth or pond/pool level of the light and heavy phase feed materials within the bowl. In order to properly operate the decanter centrifuge, the pond level must be precisely set, especially when operating at neutral or negative dam settings, that is when the pond surface is radially even with or inward of the heavy phase discharge weir. Unfortunately, precise dam settings to achieve this pond level cannot be designed prior to installation of the centrifuge since dam settings depend upon the nature and characteristics of the feed mixture especially the separated solids. Moreover, the exact pond level is sensitive to the height of the liquid crest as it flows over the weir surface of the dam. This height of the crest must be considered in determining the depth of the pond.

The conventional approach is to adjust the dam settings upon installation. This is ordinarily accomplished by taking several different sized annular plate dams to the site, and exchanging them on a trial and error basis until an optimal pond level setting has been achieved. Obviously, this wastes an excessive amount of time. In addition, this process requires manufacturing several dam plates, yet only one dam plate is finally installed. Since this approach involves the transportation of ultimately superfluous parts, excessive installation time, and the manufacturing of ultimately unused parts, this conventional method is obviously inefficient and expensive.

As stated above, a factor which must be taken into consideration when setting the pond level is cresting. The height of the crest of the feed material above the weir surface varies as a direct function of the feed rate into the decanter centrifuge. When feed material is fed into the centrifuge at a relatively higher rate, a higher crest results, and hence a higher pond level. Since the feed rate to a decanter centrifuge is ordinarily not constant, it is desirable that the weir surface and dam structure be designed to minimize changes in crest height in response to changes in the feed rate into the centrifuge. In other words, it is desirable to have a weir geometry for which the height of the crest is relatively insensitive to the feed rate.

The present invention is directed to a device for adjusting the weir surface of the light phase materials dam. In particular, the interest is in adjusting the cresting height of the light phase materials which flow over the weir surface. To this end, a pair of annular plates are placed in coaxial parallel juxtaposition at the light phase materials discharge outlet of the centrifuge. Each of the plates includes a plurality of notches defining generally arcuate openings in the plate, the openings being located on the inner periphery thereof. The light phase materials are discharged through the arcuate openings. In the preferred embodiment, the plates have an identical number of arcuate openings positioned and spaced at the same angular location. Each of the arcuate openings is of an identical arcuate width, which defines the weir surface length, and a substantially identical depth positioned at a predetermined radial distance from the axis of rotation of the bowl. One annular plate is rotatably or angularly adjustable with respect to the other such that the arcuate width of the arcuate openings may be increased or decreased by increasing or decreasing the amount of overlap of the openings. Therefore, by rotating the plates relative to each other, the weir surface length can be increased or decreased, and, consequently, the crest height and pond level can be correspondingly changed. Moreover, this plate geometry is relatively insensitive to changes in feed rate of the feed material into the centrifuge.

SUMMARY OF THE INVENTION

Briefly stated, the present invention comprises a decanter centrifuge apparatus for receiving a mixture comprised of light and heavy phase material and for separating the light and heavy phase material into respective outer and inner layers. The centrifuge comprises a rotatable bowl having an inlet for receiving a stream of the mixture to be separated and has a first outlet for discharging the heavy phase material from the bowl. A conveyor screw is rotatably and coaxially mounted within the bowl for conveying the heavy phase material toward the first outlet. A power means is operatively associated with the bowl and the conveyor screw for rotation of the bowl at a speed sufficient to maintain the mixture within the bowl under centrifugal force and for rotation of the conveyor screw at a speed which is slightly different from the speed of the bowl. The bowl further includes a second outlet for discharging the light phase material. The second outlet is configured to maintain an annular pool of mixture at a predetermined depth within the bowl. The second outlet further includes a first annular plate having at least one notch and a second annular plate having at least one notch, the plates being in coaxial parallel juxtaposition. Each of the notches includes a weir surface having a predetermined length. The notch or notches of the first annular plate are operatively associated with the notch or notches of the second annular plate for varying the length of the weir surface of the second outlet to control the predetermined depth of the annular pool.

BRIEF DESCRIPTION OF THE DRAWINGS

The foregoing summary, as well as the following detailed description, will be better understood when read in conjunction with the appended drawings. For the purpose of illustrating the invention, embodiments which are presently preferred are shown in the drawings. It is understood, however, that this invention is not limited to the precise arrangements and instrumentalities shown. In the drawings.

DESCRIPTION OF PREFERRED EMBODIMENT

Figure 1:
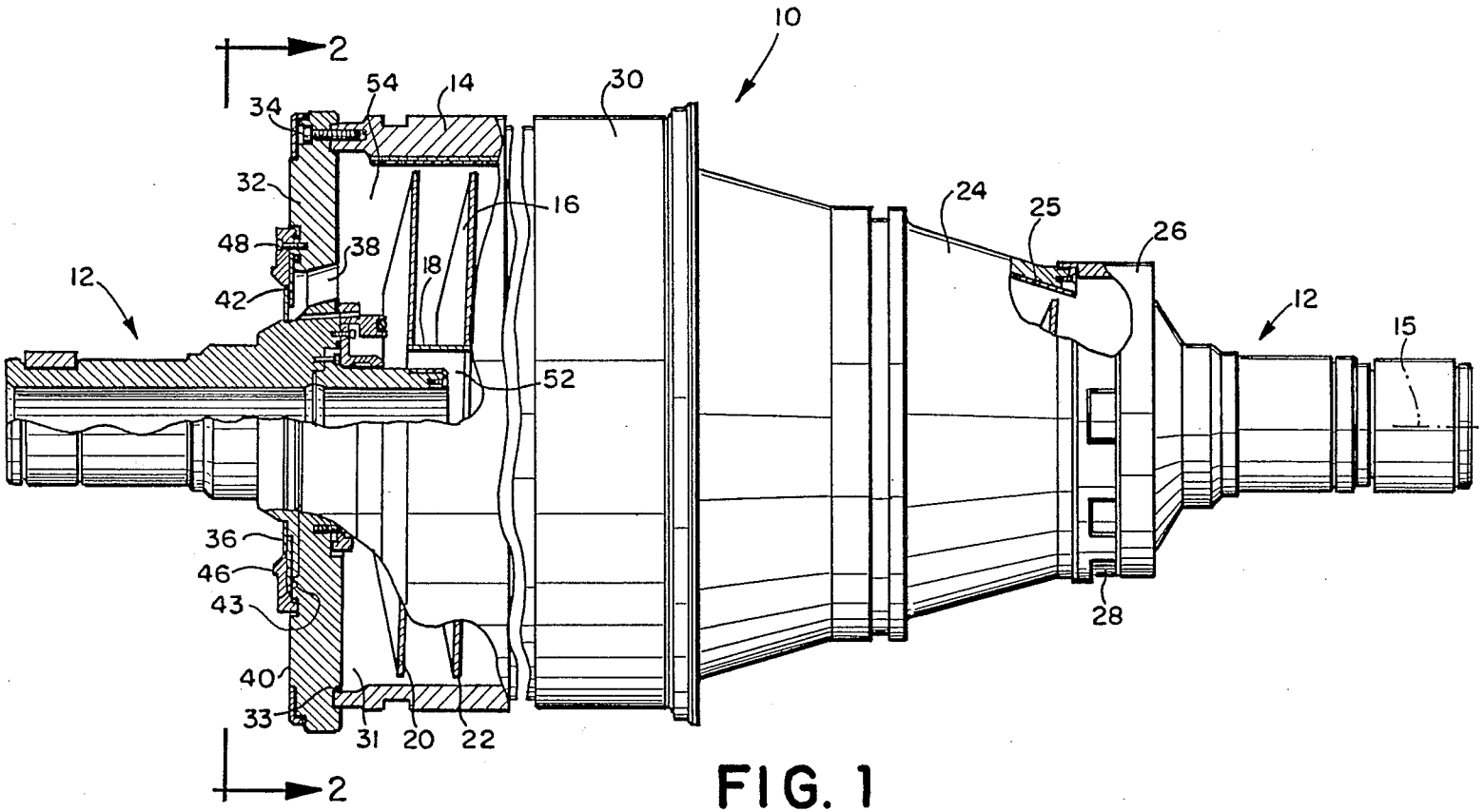
FIG. 1 is an elevation view, partly in section, of a decanter centrifuge in accordance with the present invention.

Certain terminology is used in the following description for convenience only and should not be considered limiting. For example, the words "right," "left," "lower" and "upper" designate directions in the drawings to which reference is made. The words "inwardly" and "outwardly" refer to directions toward and away from, respectively, the geometric center of the centrifuge and designated parts thereof. Said terminology includes the words above specifically mentioned, derivatives thereof and words of similar import.

Referring to the drawings in detail, wherein like numerals indicate like elements throughout, there is shown in FIGS. 1 through 6 a preferred embodiment of a decanter centrifuge in accordance with the present invention. Centrifuges of this general type are commercially available which can be referred to for additional details concerning the general structure and operation of the centrifuge hereinafter described.

Referring now to FIG. 1, the centrifuge, generally designated as 10, is shown. Typically, the centrifuge 10 comprises a frame (not shown) into which are journaled the ends 12 of a generally hollow, elongated centrifuge bowl 14 of a circular cross-section. The bowl 14 preferably is mounted for rotation about its longitudinal axis 15 within a housing (not shown) of the frame. The bowl 12 is typically belt-driven by a motor (not shown), which rotates the bowl 14 at speeds capable of generating centrifugal forces of up to several thousand times greater than the force of gravity. A more complete description of the structure of the bowl, the frame, the housing and the motor, as well as a description of the operation thereof, may be obtained from the above-referenced U.S. Pat. No. 3,795,361.

Disposed within bowl 14 and mounted coaxially therewith, is a helical screw conveyor 16 which rotates at a speed slightly different from that of bowl 14. Preferably, the screw conveyor 16 is driven by the same motor that drives the bowl. In the presently preferred embodiment, the screw conveyor 16 rotates slightly slower than the bowl 14, however, the invention is not limited thereto as the conveyor 16 may rotate slightly faster than the bowl 14, provided that the direction of the flights 20 is reversed. Adjustment of the rotational speed differential between the bowl 14 and the conveyor 16 is normally accomplished through the use of a planetary gear box (not shown). The helical screw conveyor 16 includes a generally hollow hub 18 having one or more screw flights 20 extending radially outwardly therefrom. The radially outer or distal edges 22 of the screw flights 20 generally complement the inside contour of bowl 14, but are spaced a short distance therefrom to provide sufficient clearance therebetween to prevent the distal edges 22 from rubbing against the interior of bowl 14. The present invention is not restricted to any particular helical screw conveyor.

Bowl 14 is provided at its right end with a generally tapered or convergent portion 24, with the interior thereof commonly referred to as the beach area 25. Adjacent to the tapered end portion 24 is a solids or heavy phase materials discharge outlet 26. In the preferred embodiment, the discharge outlet 26 includes a plurality of generally arcuate discharge openings 28 symmetrically arranged at spaced locations around the circumference of the outlet 26.

Figure 6:
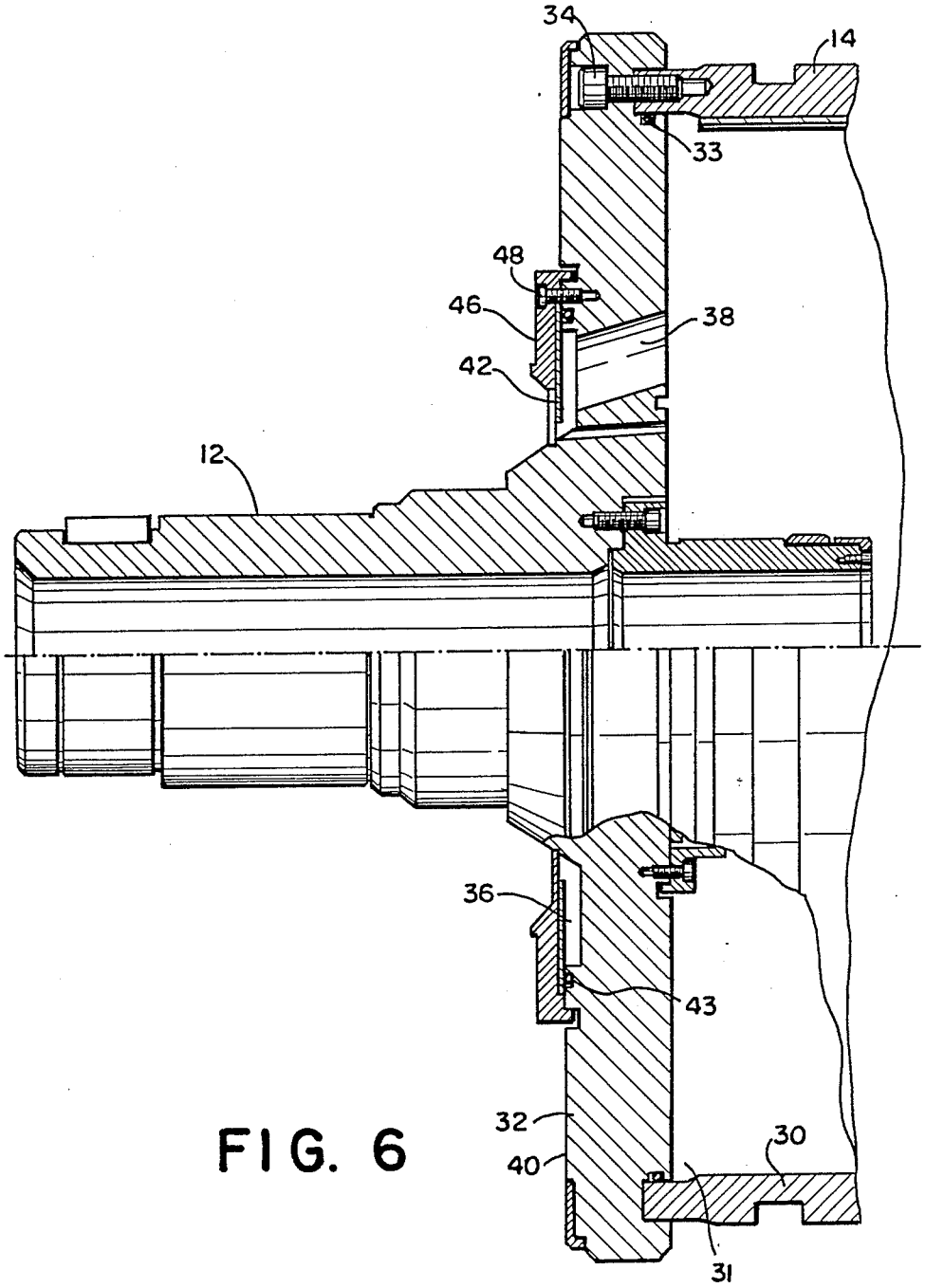
FIG. 6 is a blown-up partial view of FIG. 1 showing the weir structure of the present invention.

Referring now to FIG. 6, the left end 30 of bowl 14 is generally of tubular cylindrical construction and includes an open generally circular end 31. A generally cylindrical hub member 32 is sealingly secured to the open end 31 of bowl 14. In the preferred embodiment, an O-ring 33 or some other suitable sealing means is located between bowl 14 and hub member 32 for sealing the connection between the bowl 14 and the hub member 32 and, to prevent fluids from escaping therebetween. Preferably, the hub member 32 is secured to the open end 31 of bowl 14 by bolts 34 positioned about the hub periphery. However, but other securing means could alternatively be employed. Hub member 32 includes an outer surface or face 40 having a coaxial annular bore 36 extending therethrough and defining a discharge outlet for liquids or light phase materials within bowl 14. The annular bore 36 is in fluid communication with the interior of bowl 14, through channel 38.

Coaxially mounted on the outer face 40 of hub member 32 is a first generally annular weir plate 42. The outer diameter of weir plate 42 is greater than the outer diameter of annular bore 36 and the inner diameter of weir plate 42 is greater than the inner diameter of annular bore 36. Suitable sealing means 43 are positioned between the first annular weir plate 42 and the outer face 40 of hub member 32 to prevent fluid from passing therebetween. In the preferred embodiment, the sealing means 43 is an O-ring formed of an elastomeric sealing material of a type well known in the art, however, any method for creating a fluid seal between two flat surfaces can be substituted therefor. Positioned axially outwardly of said first annular weir plate 42 in coaxial parallel juxtaposition is a second generally annular weir retainer plate 46. The first annular weir plate 42 is received within a coaxial generally circular bore in the inner surface of the second annular weir plate retainer 46 for axially aligning the plates with respect to each other. The second annular weir plate retainer 46 has an outer diameter which is at least slightly greater than the outer diameter of both the first annular weir plate 42 and annular bore 36. The annular area defined between the outer diameter of first annular weir plate 42 and the outer diameter of second annular weir plate retainer 46 includes a plurality of circumferentially spaced generally circular openings for receiving a corresponding plurality of securing means, preferably in the form of bolts 48, for securing the first and second annular plates 42 and 46 to hub member 32.

Figure 2:
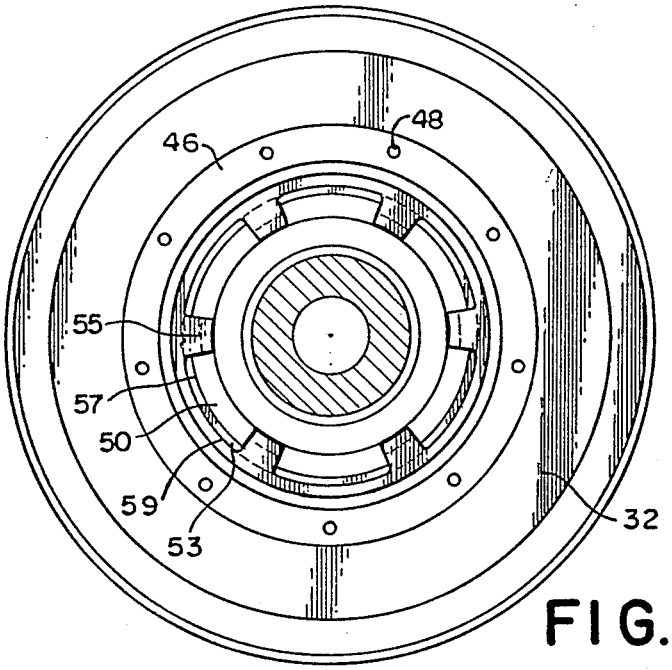
FIG. 2 is a sectional view of FIG. 1 taken along line 2—2 showing a weir structure of the present invention in a first position.
Figure 3:
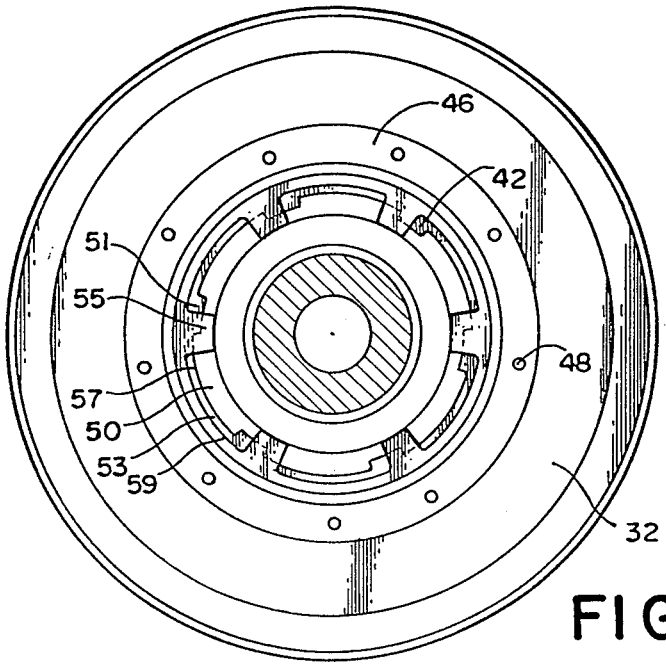
FIG. 3 is a view similar to FIG. 2 showing the weir structure in a second position.
Figure 4:
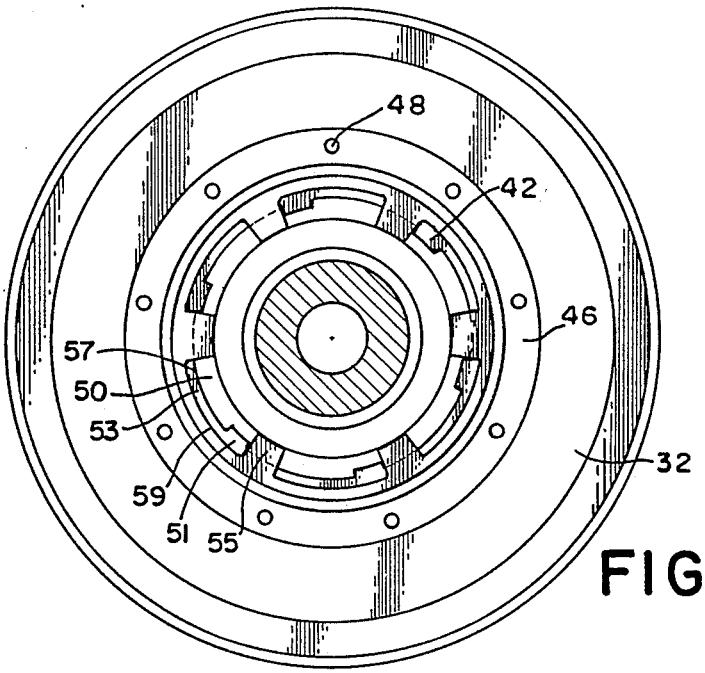
FIG. 4 is a view similar to FIG. 2 showing the weir structure in a third position.

Referring now to FIGS. 2, 3 and 4, the first annular weir plate 42 is shown positioned behind the second annular weir plate retainer 46. In the presently preferred embodiment, the first annular weir plate 42 includes six notches, each defining a generally arcuate opening 50 located on the inner periphery thereof. Located between and defining the arcuate openings 50 are six generally arcuate blocking members 51 also located around the inner periphery of weir plate 42, for defining a predetermined arcuate length of said arcuate openings 50. The radial depth of said arcuate openings 50 define a weir surface 57 having said predetermined arcuate length. The second annular weir plate retainer 46 also includes six notches, each defining a generally arcuate opening 53 on the inner periphery thereof. Located between and defining the arcuate openings 53 are six generally arcuate blocking members 55, for defining a predetermined arcuate length of said arcuate openings 53. The radial depth of the arcuate openings 53 defined by surface 59 is greater than the radial depth of the weir surface 57 of arcuate openings 50. It is recognized that the present invention is not limited to any specific number, size or shape of the notches or arcuate openings and it is therefore within the spirit and scope of the invention to use one or more such arcuate openings.

Figure 5:
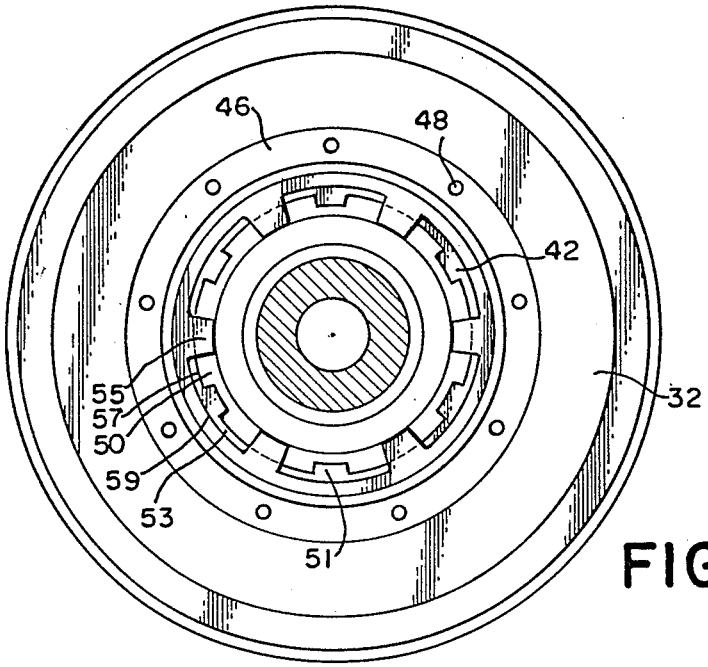
FIG. 5 is a view similar to FIG. 2 showing the weir structure in a fourth position.

The six arcuate openings 50 on the first annular weir plate 42 are positioned and circumferentially spaced at about the same angular locations as the six arcuate openings 53 on the second annular weir plate retainer 46. In the present embodiment, each of the arcuate openings 50 and 53 have an identical arcuate length. In addition, the depth of each arcuate opening 50 is positioned at a predetermined radial distance from the longitudinal axis of the plate 42 and bowl 14, to define a weir surface 57. Therefore, the plates can be angularly positioned as shown in FIG. 2 to place the arcuate openings 53 and 50 in registry or in a partially overlapping relationship as shown in FIGS. 3, 4 and 5 as hereinafter described.

Referring now to FIG. 1, hub 18 of helical screw conveyor 16 being hollow, defines an area therewithin designated as feed chamber 52. The process feed stream, or light and heavy phase feed material mixture to be separated, is introduced into feed chamber 52 through a stationary feed tube (not shown). The feed tube extends generally axially within the feed chamber 52. The feed material mixture then passes through a plurality of radially extending conduits or passages (not shown) disposed within hub 18 of helical screw conveyor 16 and into a separation area 54. The feed material mixture travels radially outwardly and forms an annular pool radially inward of the inner surface of bowl 14. The centrifugal force on the pool created by the creation of bowl 14 causes the feed to separate into a radially inner layer of light phase material and a radially outer layer of heavy phase material. Due to the controlled differential in the speeds of rotation of helical conveyor screw 16 and bowl 14, the conveyable solids or heavy phase material are urged toward the beach area 25 by the conveyor flights 20 for discharge through outlet openings 28. At the same time, the liquid or light phase material is discharged through annular bore 36 around blocking members 51 and 55, through arcuate openings 50 and 53, over weir surface 57. The pond level within the bowl 14 is determined by the radial depth of the weir surface 57 and the relative angular position of the first and second plates 42 and 46 with respect to each other, as described hereinafter.

As shown in FIG. 2, first and second annular plates 42 and 46 are set in a first relative angular position with respect to each other, such that the arcuate openings 50 on first annular weir plate 42 are in substantial registry with the respective arcuate openings 53 of second annular weir plate retainer 46. Plate 42 is positioned by loosening the bolts 48 to permit it to be rotated to a selected angular position relative to plate 46. Conventional weir structures include notched and unnotched annular plates. Notched plates are used to start up centrifuges operating at negative dam. However, the notches are not adjustable. Another type of conventional weir structure includes crescent dams, each of which is a crescent shaped plate partially covering a hole 38 in hub member 32. Each hole is partially covered by a crescent dam to define a weir surface However, this type of weir structure is rate sensitive because it has a weir length that is substantially less than 360 degrees. A commercial centrifuge sold by Sharples, Inc. of Warminster, Pa. under the designation of PM-75,000 centrifuge has six holes of 4.5 inch diameter in the hub. This provides a 27 inch total weir surface on an 18.5 inch diameter circle; that is, a weir of 167 degrees, which is less than one-half of 360 degrees.

In one embodiment, each arcuate opening 50 and 53 has an arcuate length of about 45 degrees and each blocking member has an arcuate length of about 15 degrees (i.e., a 45/15 weir system), as measured from the longitudinal axis of bowl 14. Since the annular plates 42 and 46 are relatively angularly positioned such that the arcuate openings 50 and 53 are in registry, the total weir surface, as shown in FIG. 2, is about 270 degrees. In this relative angular position, for a general flow rate the crest height of light phase material or liquid flowing through the arcuate openings 50 and over weirs 57 is at the lowest permissible level and consequently so is the pond level. For example, in one embodiment, a commercial centrifuge sold by Sharples, Inc. of Warminster, Pa. under the designation of PM-76,000 AD, utilizes a 45/15 weir system positioned in registry, with each arcuate opening having an arcuate length of 5.301 inches. A feed rate of 300 gallons per minute (GPM) and a rotation rate of 2600 revolutions per minute (RPM) yields a crest height of 0.197 inches.

Referring now to FIG. 3, the annular plates 42 is shown in a second angular position relative to plate 46, such that arcuate openings 50 on first annular weir plate 42 are aligned in a partially overlapping relationship with arcuate openings 53 of the second annular weir plate retainer 46 and with blocking members 55 partially covering arcuate openings 50, to effectively vary or decrease the size of the arcuate length of arcuate opening 50 for decreasing the length of the total weir surface 57. Specifically, the annular plate 42 is rotated 7½ degrees with respect to plate 46. Therefore, the plates, acting in concert, are formed and angularly positioned to define six arcuate openings having an arcuate width of about 37½ degrees or an overall weir surface of 225 degrees. Since the overall weir surface 57 is decreased, the crest height of the liquid or light phase material flowing over the weir surface 57 is proportionally and correspondingly increased, given the same feed rate as for the 45 degree setting. Consequently, the pond level is also increased correspondingly. For instance, positioning the annular plates 42 and 46 in the 37½ degree position, results in a weir length of 4.418 inches. In this position a feed rate of 300 GPM and a rotation rate of 2600 RPM yields a crest height of 0.222 inches or an increase of 0.025 inches as compared to the position of FIG. 2.

The process for changing the relative angular positions of the first and second annular plates 42 and 46, and thus the pond level, has advantages compared to the prior art. By loosening the bolts 48, the first annular weir plate 42 can be readily rotated with respect to the second annular weir plate retainer 46. Once the first annular weir plate 42 is positioned in its selected angular position, it may be secured there by retightening the bolts 48. Consequently, the pond level of the mixture within the bowl is readily adjustable, without having to fully disassemble and/or remove the weir structure.

Referring now to FIG. 4, the first and second annular plates 42 and 46 of the preferred embodiment are shown in a third relative angular position with respect to each other, such that arcuate openings 50 on first annular weir plate 42 are aligned in a partially overlapping relationship with arcuate openings 53 of the second annular weir plate retainer 46 to effectively vary the arcuate length of each arcuate opening 50 for decreasing the overall size of the weir surface. Specifically, the annular plate 42 is rotated 15 degrees with respect to plate 46 to a maximum overlapping position. Therefore, the plates, acting in concert, are formed and angularly positioned to define six arcuate openings having an arcuate length of about 30 degrees or an overall weir surface of about 180 degrees. Since the overall weir surface is decreased, as compared to the first and second relative angular positions, the crest height of the liquids or light phase materials flowing over the weir surface 57 is proportionally and correspondingly increased, again assuming the same feed rate. Consequently, the pond level is also increased correspondingly to a maximum depth. For example, positioning the annular plates 42 and 46 in the 30 degree position results in an arcuate length of 3.534 inches. In this position a feed rate of 300 GPM and a rotation rate of 2600 RPM yields a crest height of 0.258 inches or an increase of 0.061 as compared to the position of FIG. 2.

Generally, by moving the first and second annular plates 42 and 46 angularly relative to each other, the crest height and pond level of the mixture within the centrifuge can be finely adjusted. In the preferred embodiment, the plate 42 is manufactured in two generally symmetrical pieces to facilitate installation. As discussed hereinbefore, the present invention eliminates the need to carry an inordinate number of varying sizes of plates to a job site, by allowing one pair of plates to perform pond level adjustments that heretofore required a plurality of different plates.

Regardless of the relative angular position of the annular plates 42 and 46, the crest height is substantially insensitive to the mixture feed rate. For example, a 45/15 weir system, positioned at the 30 degree position (as shown in FIG. 4), given a rotation rate of 2600 RPM and a feed rate of 200 GPM yields a crest height of approximately 0.197 inches, while at 400 GPM, the crest height would increase to approximately 0.313 inches. Therefore, the change in crest between the two flow rates is only 0.116 inches.

The invention is ideally suited for separation of secondary sewage, sludge (e.g., waste activated sludge) or other materials wherein the light and heavy phase materials are of nearly the same specific gravity, and wherein the solids may be fine and very slippery when wet. Accordingly, the terms "heavy phase" and "light phase" have been employed to describe the materials which are separable by the centrifuge of the present invention.

While the preferred embodiment discloses a specific geometric notch shape, the present invention is not limited thereto. For instance, the arcuate length of arcuate openings 50 and 53 may be any appropriate length, such as a 50/10 weir system, a 55/5 weir system or any other variation thereof, without departing from the scope and spirit of the invention. Also the weir surfaces 57 need not be arcuate. Correspondingly, as previously mentioned, the number of notches is also variable and may include one or more. Therefore, it is within the spirit and scope of the invention to provide different arcuate opening geometries (i.e., shapes and angles) to allow for varying degrees of sensitivity based on the relative angular position of plates 42 and 46. In the same light, the invention is not limited to the relative angular position of plates 42 and 46 as depicted in FIGS. 2, 3 and 4, as it is recognized that the plates 42 and 46 can be angularly positioned with respect to each other in an infinite number of positions, to obtain different desired results. For instance, FIG. 5 shows another relative angular position of plates 42 and 46, wherein each blocking member 55 is positioned intermediate of each arcuate opening 50.

While the invention has been disclosed as having two annular plates, it is within the spirit and scope of the invention to use one annular plate having a plurality of notches, wherein the plate includes means attached thereto for adjusting the arcuate length of the notches.

From the foregoing description, it can be seen that the present invention comprises an adjustable weir structure for a decanter centrifuge apparatus for receiving a mixture comprised of light and heavy phase materials and for separating the light and heavy phase materials into respective outer and inner layers. It will be appreciated by those skilled in the art that changes could be made to the embodiment described above without departing from the broad inventive concepts thereof. It is understood, therefore, that this invention is not limited to the particular embodiment disclosed, but is intended to cover all modifications which are within the scope and spirit of the invention as defined by the appended claims.

I claim:

1. A decanter centrifuge apparatus for receiving a mixture comprising a light and heavy phase material and for separately discharging the light and heavy phase material, comprising: a rotatable bowl having an inlet for receiving a stream of said mixture to be separated and having a first outlet for discharging heavy phase material from said bowl; a conveyor screw rotatably and coaxially mounted within said bowl for conveying heavy phase material toward said first outlet, said bowl being rotatable at a speed sufficient to maintain the mixture within the bowl under centrifugal force, separating the mixture into respective outer and inner layers of light and heavy phase material, and the conveyor screw being rotatable at a speed slightly different from the speed of rotation of the bowl, said bowl further comprising a second outlet for discharging said light phase material, said second outlet being configured to maintain an annular pool of the mixture at a predetermined depth within said bowl, said second outlet including a first annular plate having at least one notch and a second annular plate having at least one notch, said plates being in coaxial parallel juxtaposition, said notch of said first annular plate including a weir surface of variable length formed by a radially outer surface of the notch over which the light phase material is discharged, said notch of said first annular plate being operatively associated with said notch of said second annular plate for varying the length of the weir surface while its radial position remains fixed to control the depth of said annular pool.

2. The decanter centrifuge as recited in claim 1 wherein the length of said weir surface of the second outlet and said predetermined depth of said annular pool are determined by the relative angular position of the notches in said first and second annular plates with respect to each other.

3. The decanter centrifuge as recited in claim 1 wherein said first and second annular plates are angularly positioned such that said notches are in an overlapping relationship, said predetermined depth of said annular pool being responsive to said overlapping relationship.

4. The decanter centrifuge as recited in claim 3 wherein said notches have a predetermined radial depth, said predetermined depth of said at least one notch of said first annular plate defining a weir radius of said second outlet.

5. The decanter centrifuge as recited in claim 1 wherein said first annular plate is angularly positioned relative to said second annular plate varying the length of said weir surface of the second outlet to control said predetermined depth of said annular pool.

6. A decanter centrifuge apparatus for receiving a mixture comprised of light and heavy phase material and for separating the light and heavy phase material into respective inner and outer layers, comprising:

a rotatable bowl having an inlet for receiving a stream of said mixture to be separated and having a first outlet for discharging said heavy phase material from said bowl;

a conveyor screw rotatably and coaxially mounted within said bowl for conveying said heavy phase material toward said first outlet, said bowl being rotatable at a speed sufficient to maintain the mixture within the bowl under centrifugal force and the conveyor screw being rotatable at a speed which is slightly different from the speed of rotation of the bowl; and said bowl further comprising a second outlet for discharging said light phase material, said second outlet being configured to maintain an annular pool of the mixture at a predetermined depth within said bowl, said second outlet including a first annular plate and a second annular plate in coaxial parallel juxtaposition, each plate including at least one notch located on the inner periphery thereof, said light phase material being discharged through said notch, said first annular plate being angularly positioned relative to said second annular plate such that said notches are in an overlapping relationship so as to define a generally arcuate opening through said annular plates and to effectively vary the size of said generally arcuate opening for varying the size of said second outlet to control said predetermined depth of said annular pool.

7. A decanter centrifuge apparatus for receiving a mixture comprised of light and heavy phase material and for separating the light and heavy phase material into respective inner and outer layers, comprising:

a rotatable bowl having an inlet for receiving a stream of said mixture to be separated and having a first outlet for discharging said heavy phase material from said bowl;

a conveyor screw rotatably and coaxially mounted within said bowl for conveying said heavy phase material toward said first outlet, said bowl being rotatable at a speed sufficient to maintain the mixture within the bowl under centrifugal force and the conveyor screw being rotatable at a speed which is slightly different from the speed of rotation of the bowl; and said bowl further comprising a second outlet for discharging said light phase material, said second outlet being configured to maintain an annular pool of the mixture at a predetermined depth within said bowl, said second outlet including a first annular plate and a second annular plate in coaxial parallel juxtaposition, each plate including a plurality of arcuate notches and blocking members in the plate, the notches and blocking members located on the inner periphery thereof, said light phase material being discharged through said arcuate openings, said first and second annular plates having an identical number of arcuate notches positioned and spaced at the same angular locations, each of said arcuate notches having a substantially identical arcuate length, said arcuate notches of said first annular plate having a radial depth positioned at a first predetermined radial distance from the axis of rotation of said bowl, said arcuate notches of said second annular plate having a radial depth positioned at a second predetermined radial distance from the axis of rotation of the bowl, said second predetermined radial distance being greater than said first predetermined radial distance, said first and second annular plates having a first relative angular position with respect to each other such that said arcuate notches on said first annular plate are in registry with said arcuate notches of said second annular plate and said first and second annular plates having a second relative angular position with respect to each other such that said arcuate notches on said first annular plate are aligned in a partially overlapping relationship with said arcuate notches of said second annular plate to define generally arcuate openings for discharge of said light phase material and to effectively vary the arcuate length of said generally arcuate openings, to control said predetermined depth of said annular pool.

8. A decanter centrifuge apparatus for receiving a mixture comprised of a light and heavy phase material and for separately discharging the light and heavy phase material, comprising: a rotatable bowl having an inlet for receiving a stream of said mixture to be separated and having a first outlet for discharging heavy phase material from said bowl; a conveyor screw rotatably and coaxially mounted within said bowl for conveying heavy phase material toward said first outlet, said bowl being rotatable at a speed sufficient to maintain the mixture within the bowl under centrifugal force, separating the mixture into respective inner and outer layers of light and heavy phase material, and of the conveyor screw being rotatable at a speed slightly different from the speed of rotation of the bowl, said bowl further comprising a second outlet for discharging said light phase material, said second outlet configured to maintain an annular pool of the mixture at a predetermined depth within said bowl, said second outlet including a first annular plate and a second annular plate in coaxial parallel juxtaposition, said plates each having notches positioned to define at least one opening for discharge of the light phase material, said opening having a weir surface of adjustable length on the radially outward periphery of the opening, the radial position of the weir surface being fixed, said light material being discharged through said opening and over said weir surface, said weir surface length defined by the relative angular position of said plates with respect to each other wherein said predetermined depth of said annular pool is responsive to said adjustable length of said weir surface.

9. A decanter centrifuge apparatus for receiving a feed mixture comprised of a light and heavy phase material and for separating the light and heavy phase material into respective outer and inner layers, the centrifuge comprising a bowl mounted for rotation about an axis of rotation and for receiving the feed mixture and a conveyer screw means mounted therewithin for conveying heavy phase material from said bowl, the bowl including a first outlet for discharge of heavy phase material and a second outlet for discharge of light phase material, wherein the improvement comprises: said second outlet including a first annular plate having at least one notch on the inner periphery thereof for discharging said light phase material therethrough and a second annular plate in coaxial parallel juxtaposition with said first annular plate, said second plate including at least one notch on the inner periphery thereof for discharging said light phase material therethrough, said first and second annular plates being angularly positioned such that said notch on said first annular plate and said notch on said second annular plate are in an overlapping relationship, said angular position of both said plates being adjustable to vary the overlapping relationships and to thereby vary the depth of the annular pool.

10. A decanter centrifuge apparatus for receiving a mixture comprised of light and heavy phase material and for separately discharging the light and heavy phase material, comprising: a rotatable bowl having an inlet for receiving a stream of said mixture to be separated and having a first outlet for discharging heavy phase material from said bowl; a conveyor screw rotatably and coaxially mounted within said bowl for conveying heavy phase material toward said first outlet; and said bowl being rotatable at a speed sufficient to maintain the mixture within the bowl under centrifugal force, separating the mixture into respective inner and outer layers of light and heavy phase material, and the screw conveyor being rotatable at a speed slightly different from the speed of rotation of the bowl, said bowl further comprising a second outlet for discharging light phase material from the bowl and to maintain an annular pool of the mixture at a predetermined depth within said bowl, said second outlet including an annular plate including at least one notch establishing an opening from the bowl for discharge of the light phase material, the opening having a weir surface on the radially outward periphery thereof, said light phase material being discharged through said opening over said weir surface, and blocking means adapted to protrude inwardly into said notch, a weir length being defined by the relative angular position of said plate and said blocking means with respect to each other wherein said predetermined depth of said annular pool is responsive to the weir length of said opening and wherein the radial position of the weir surface is fixed.

11. A weir structure for use within a liquid discharge passageway of a decanter centrifuge comprising: a first annular plate having at least one notch located on the radially inward periphery thereof; and a second annular plate in coaxial parallel juxtaposition with said first annular plate, said second annular plate having at least one notch located on the radially inward periphery thereof, said first and second annular plates being angularly positioned such that said notch on said first annular plate and said notch on said second annular plate are in an overlapping relationship and define a generally arcuate opening where they overlap, the relative angular position of said plates being adjustable to thereby vary the arcuate length of the arcuate opening, the radial position of the opening remaining fixed.

12. A process for adjusting the depth of an annular pool of a light and a heavy phase material mixture in a decanter centrifuge comprising a rotatable bowl having an inlet for receiving said mixture to be separated and having a first outlet for discharging said heavy phase material from said bowl, a conveyor screw rotatably and coaxially mounted within the bowl for conveying said heavy phase material toward said first outlet, said bowl further comprising a second outlet for discharging said light phase material, said second outlet configured to maintain an annular pool of mixture at a predetermined depth within said bowl, said second outlet including a first annular plate and a second annular plate being in coaxial parallel juxtaposition, each including at least one notch defining a generally arcuate opening located on the inner periphery thereof, said light phase material being discharged through said arcuate opening, said first and second annular plates having an identical number of notches and spaced at the same angular locations, each of said notches having a substantially identical arcuate length, said notches of said first annular plate having a radial depth positioned at a first predetermined radial distance from an axis of rotation of said bowl, said notches of said second annular plate having a radial depth positioned at a second predetermined radial distance from an axis of rotation of the bowl and said second predetermined radial distance being greater than said first predetermined distance, said process for adjusting said depth of said angular pool comprising the steps of: adjusting the relative angular position of said and first and second annular plates such that said notches on said first annular plate are aligned in registry or in partially or wholly overlapping relationship with said notches of said second annular plate and varying the length of said arcuate opening to adjust the depth of said annular pond.

13. A decanter centrifuge as recited in claim 10 wherein said blocking means is positioned intermediate said notch.

* * * * *